US005901906A

United States Patent [19]

Bouldin

[11] Patent Number: 5,901,906

[45] Date of Patent: May 11, 1999

[54] MULTI-ORIFICE ALGAE CLEANING TIP FOR POOL WHIP HOSES

[76] Inventor: David W. Bouldin, 1927 Shadow Bend Dr., Houston, Tex. 77043

[21] Appl. No.: 08/880,337

[22] Filed: Jun. 23, 1997

[51] Int. Cl.[6] ..... E04H 4/16; B05B 3/00

[52] U.S. Cl. ..... 239/229; 239/251; 239/556; 239/567; 239/588; 4/490; 15/1.7; 134/167 R

[58] Field of Search ..... 15/1.7; 4/490; 134/166 R, 167 R, 168 R, 166 C, 167 C, 168 C; 239/229, 251, 556, 567, 568, 588

[56] References Cited

U.S. PATENT DOCUMENTS

| | | | |
|---|---|---|---|
| 182,413 | 9/1876 | Chase | 239/229 |
| 1,176,518 | 3/1916 | Burns | 239/251 X |
| 2,213,627 | 9/1940 | De Baugh | 134/167 R |
| 2,930,531 | 3/1960 | Kennedy, Jr. | 239/229 |
| 3,168,896 | 2/1965 | Berg | 134/167 R |
| 3,776,464 | 12/1973 | Proffit | 239/229 |
| 3,820,172 | 6/1974 | Kane | 134/167 R X |
| 3,872,533 | 3/1975 | Proffit | 134/167 R X |
| 4,651,377 | 3/1987 | Staples | 15/1.7 |
| 4,715,538 | 12/1987 | Lingnau | 239/556 X |
| 4,850,538 | 7/1989 | Krahn | 239/568 X |
| 5,573,187 | 11/1996 | Proctor | 134/167 R X |
| 5,617,609 | 4/1997 | Bently | 239/229 X |

FOREIGN PATENT DOCUMENTS

| | | | |
|---|---|---|---|
| 2263037 | 10/1975 | France | 239/251 |

*Primary Examiner*—Mark Spisich
*Attorney, Agent, or Firm*—Kenneth A. Roddy

[57] ABSTRACT

A hollow cylindrical cleaning tip installed in the free end of a whip hose assembly dislodges algae and particulate matter adhered pool surfaces and causes the hose to move along the bottom surface of a water filled pool in a sinuous whipping action to agitate the water and keep suspended particulate matter in suspension. The cleaning tip has a cylindrical side wall defining a central chamber, a tubular water inlet extending from a bottom end secured in the hose free end, a central orifice extending through a top end, and a plurality of circumferentially spaced orifices extending through the side wall. The central orifice discharges a pressurized jet stream of water axially from the cleaning tip in the direction of water flowing through the hose to create a reactant force causing the hose to move along the bottom surface of the pool in a sinuous whipping action to agitate the water and keep suspended particulate matter in suspension. The plurality of circumferentially spaced orifices discharge a plurality of pressurized jet streams of water radially outward from the cleaning tip with respect to the direction of water flow, and at least one of the radially outward discharged jet streams is directed onto the pool surface in a pool cleaning position to dislodge algae and debris adhered thereto and the remaining radially discharged jets create a reactant force to urge the one jet into the pool cleaning position.

1 Claim, 3 Drawing Sheets

MULTI-ORIFICE ALGAE CLEANING TIP FOR POOL WHIP HOSES

BACKGROUND OF THE INVENTION

1. Field of the Invention

This invention relates generally to swimming pool cleaning apparatus, and more particularly to a multi-orifice algae cleaning tip which attaches to the free end of a swimming pool whip hose and directs powerful jets of water generally perpendicular to the pool surfaces to remove algae.

2. Brief Description of the Prior Art

Numerous devices are known for removing sediment and suspended particulate matter from swimmming pools. Manually operated vacuuming devices require considerable manual labor. Other known pool cleaning devices utilize one or more flexible "whip hoses" through which water is discharged into the pool under pressure. The "whip hoses" whip back and forth along the bottom of the pool in a sinuous whipping action to agitate the water and keep the particulate matter in suspension so that it can be removed by the filtration system. Most common whip hoses have an orifice tip or nozzle installed in their free end which discharges a single high velocity jet of water forwardly from the free end of the whip hose in the direction of the hose axis such that the reactant force causes the whipping action.

Various attachments for pool whip hoses have been developed to enhance the whipping action and to prevent abrading of the hose due to its constant contact and travel over the pool surface, such as plastic wear-resistant rings or rollers which are spaced along the length of the whip hose to prevent hose contact with the pool surface. Tubular brush attachments, or "scrubbers" formed of foam material are also known that may be placed along the length of the whip hose between the wear rings and at the free and of the hose to brush the pool surfaces and dislodge algae.

Mazon, III, U.S. Pat. No. 4,278,949 discloses an agitating whip hose assembly having a nozzle installed in the free end of the hose which discharges a single high velocity jet of water forwardly from the free end of the hose in the direction of the hose axis such that the reactant force causes a whipping action, a cylindrical rotatable wear ring which is installed coaxially on the nozzle, and a pair of rotatable wear rings spaced along the length of the whip hose to prevent hose and nozzle contact with the pool surface.

Pasini, U.S. Pat. No. 4,281,995 discloses a water supply hose having its free end supported by a first float with another length of hose smaller in diameter extending from the first float that has a second float attached to its free end. One or more jet couplings are installed along the length of the larger diameter supply hose and another jet coupling is at the back of the second float. Each jet coupling has a single port that ejects water rearwardly to maintain that part of the hose which is upstream from the jet in tension.

Kane, U.S. Pat. No. 4,282,893 discloses an agitating whip hose assembly including a specially shaped cleaning head which is attached to the free end of the hose and ejects water rearwardly through a plurality of ports to drive the hose forward and a plurality of jet couplings which are installed along the length of the hose, each of which has a single port that ejects water rearwardly to produce a lateral thrust against the side of the hose. The rearwardly directed jets propel the cleaning head forward dragging the hose with it and the water discharging simultaneously from the single ports of the plurality of jet couplings enhances the whipping action by producing a random trajectory of the hose to agitate the water and settled debris.

Staples, U.S. Pat. No. 4,651,377 discloses an agitating whip hose assembly having a nozzle installed in the free end of the hose which discharges a single high velocity jet of water forwardly from the free end of the hose in the direction of the hose axis such that the reactant force causes a whipping action, a plurality of wear rings spaced along the length of the whip hose to prevent hose contact with the pool surface, and one or more tubular brush attachments formed of foam material that are installed along the length of the whip hose between the wear rings and/or at the free end of the hose to brush the pool surfaces and dislodge algae.

Brooks, U.S. Pat. No. 4,839,063 discloses a pool cleaning apparatus with a floating unit and a non-buoyant cleaning unit connected by an underwater hose having a plurality of jet couplings installed along the length of the underwater hose, each of which has one or two angled ports that eject water rearwardly to displace the connectors in the water such that the non-buoyant cleaning unit moves through the water and the underwater hose pushes the floating unit around.

The prior art and conventional single orifice whip hose nozzles are designed primarily to propel the whip hose and cause a whipping action merely to stir up or agitate the water to keep the particulate matter in suspension so that the suspended particulate matter can be removed by the filtering system, rather than actually directing cleaning jets onto the pool surface to dislodge algae and debris which has already grown or adhered to the surface.

Prior art whip hoses that have tubular brush attachments installed along their length to brush the pool surfaces and dislodge algae are ineffective because they also have a single orifice and there is no provision for counteracting jets to maintain the brush elements in contact with the pool surface, thus the brushes merely skim quickly over the surface as the hose whips from side to side in a sinuous whipping action.

The present invention is distinguished over the prior art in general, and these patents in particular by a hollow cylindrical multi-orifice cleaning tip installed in the free end of a whip hose assembly which dislodges algae and particulate matter adhered pool surfaces and causes the hose to move along the bottom surface of a water filled pool in a sinuous whipping action to agitate the water and keep suspended particulate matter in suspension. The cleaning tip has a cylindrical side wall defining a central chamber, a tubular water inlet extending from a bottom end secured in the hose free end, a central orifice extending through a top end, and a plurality of circumferentially spaced orifices extending through the side wall. The central orifice discharges a pressurized jet stream of water axially from the cleaning tip in the direction of water flowing through the hose to create a reactant force causing the hose to move along the bottom surface of the pool in a sinuous whipping action to agitate the water and keep suspended particulate matter in suspension. The plurality of circumferentially spaced orifices discharge a plurality of pressurized jet streams of water radially outward from the cleaning tip with respect to the direction of water flow, and at least one of the radially outward discharged jet streams is directed onto the pool surface in a pool cleaning position to dislodge algae and debris adhered thereto and the remaining radially discharged jets create a reactant force to urge the one jet into the pool cleaning position.

SUMMARY OF THE INVENTION

It is therefore an object of the present invention to provide a whip hose assembly having a multi-orifice algae cleaning tip at its free end for effectively cleaning the surfaces of a pool.

It is another object of this invention to provide a whip hose assembly having a multi-orifice algae cleaning tip at its free end which directs pressurized jets of water onto the surfaces of a pool to dislodge algae and accumulated debris.

Another object of this invention is to provide a whip hose assembly having a multi-orifice algae cleaning tip at its free end which directs at least one pressurized jet of water onto the surfaces of a pool to dislodge algae and accumulated debris and directs counteracting pressurized jets of water into the body of water to maintain the cleaning jet in a cleaning position.

A further object of this invention is to provide a whip hose assembly having a multi-orifice algae cleaning tip at its free end which directs a pressurized jet of water forwardly in the direction of the water flow such that the reactant force causes a whipping action and directs a plurality of counteracting pressurized jets of water into the body of water to control the speed of the whipping action while maintaining a cleaning jet in a cleaning position.

A still further object of this invention is to provide a multi-orifice algae cleaning tip for swimming pool whip hoses which is simple in construction, inexpensive to manufacture, and rugged and reliable in operation.

Other objects of the invention will become apparent from time to time throughout the specification and claims as hereinafter related.

The above noted objects and other objects of the invention are accomplished by a hollow cylindrical multi-orifice cleaning tip installed in the free end of a whip hose assembly which dislodges algae and particulate matter adhered pool surfaces and causes the hose to move along the bottom surface of a water filled pool in a sinuous whipping action to agitate the water and keep suspended particulate matter in suspension. The cleaning tip has a cylindrical side wall defining a central chamber, a tubular water inlet extending from a bottom end secured in the hose free end, a central orifice extending through a top end, and a plurality of circumferentially spaced orifices extending through the side wall. The central orifice discharges a pressurized jet stream of water axially from the cleaning tip in the direction of water flowing through the hose to create a reactant force causing the hose to move along the bottom surface of the pool in a sinuous whipping action to agitate the water and keep suspended particulate matter in suspension. The plurality of circumferentially spaced orifices discharge a plurality of pressurized jet streams of water radially outward from the cleaning tip with respect to the direction of water flow, and at least one of the radially outward discharged jet streams is directed onto the pool surface in a pool cleaning position to dislodge algae and debris adhered thereto and the remaining radially discharged jets create a reactant force to urge the one jet into the pool cleaning position.

DESCRIPTION OF THE PREFERRED EMBODIMENT

Figure 1:
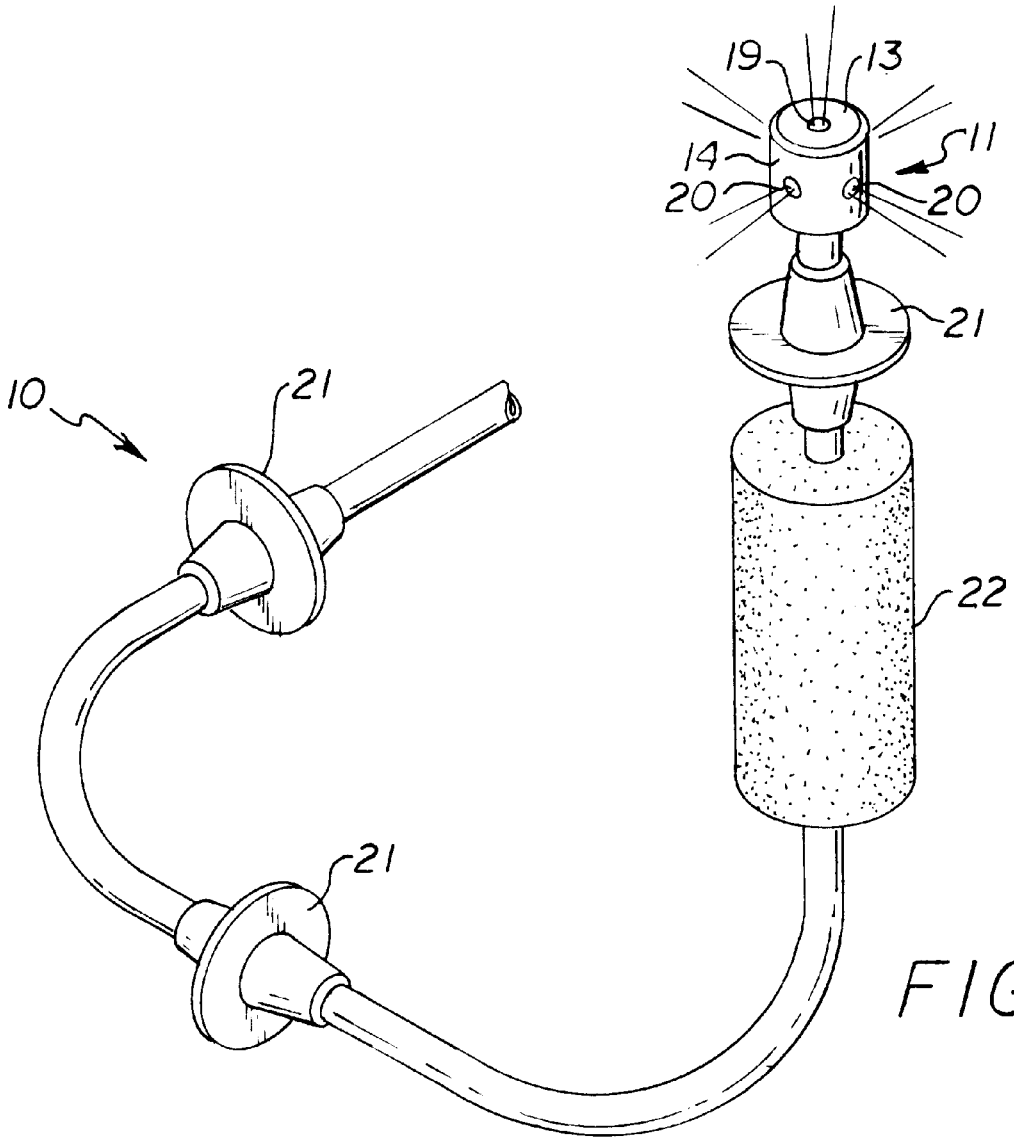
FIG. 1 is a partial perspective view of a whip hose assembly having a multi-orifice algae cleaning tip in accordance with the present invention installed in its free end.

Referring to the drawings by numerals of reference, there is shown in FIG. 1 a flexible whip hose assembly 10 for use in a swimming pool cleaning system. The whip hose 10 is connected at one end to a source of pressurized water and has a multi-orifice algae cleaning tip 11 attached at its free end through which the pressurized water is expelled.

Figure 2:
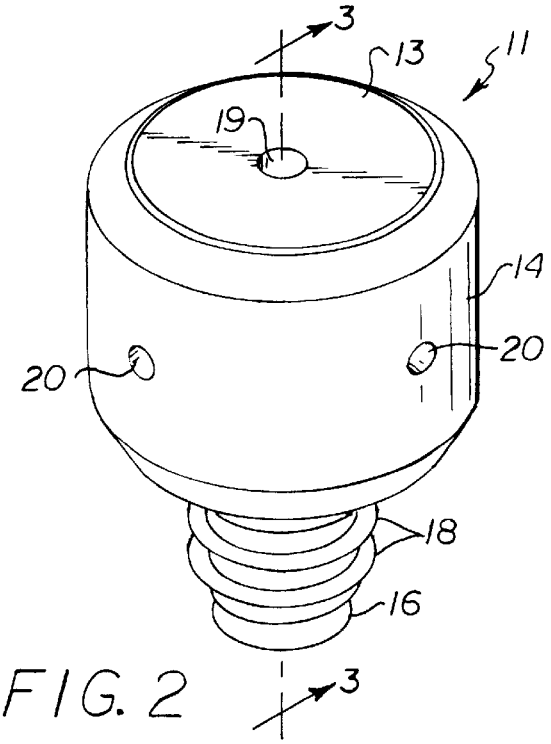
FIG. 2 is a perspective view of the multi-orifice algae cleaning tip.
Figure 3:
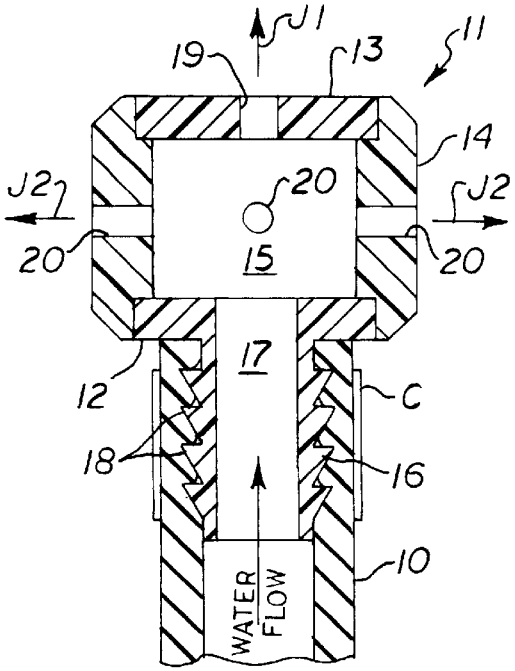
FIG. 3 is a longitudinal cross section through the multi-orifice algae cleaning tip taken along line 3—3 of FIG. 2.

As shown in FIGS. 2 and 3, the multi-orifice algae cleaning tip 11 is a hollow cylindrical member having a bottom wall 12, a top wall 13 and a cylindrical side wall 14 defining a central chamber 15. The bottom wall 12 has a tubular extension 16 with a central bore 17 and a plurality of longitudinally spaced circumferential ribs 18 on its exterior. The tubular extension 16 is sized to be received and frictionally engaged inside the free end of the whip hose 10 and secured therein by a conventional hose clamp C which surrounds the exterior of the hose.

The top wall 13 has a single central orifice 19 which discharges a jet stream J1 of water forwardly in the direction of the hose axis (direction of water flow) such that the reactant force causes a whipping action. As shown in FIG. 3, the side wall 14 has a plurality of circumferentially spaced orifices 20 which discharge a plurality of jet streams J2 of water radially outward with respect to the axis of the cleaning tip.

While the forwardly directed jet stream J1 from orifice 19 causes the free end of the hose to whip from side to side, at least one of the radially outward directed jet streams J2 from one of the orifices 20 will be directed generally perpendicular onto the surface of the pool. The reactant force of the remaining radially directed jets J2 against the body of water will tend to prevent the one jet which is directed onto the pool surface from being repelled away from the surface. In other words, the remaining radially directed jets tend to counteract the repelling force of the one jet and hold it in a cleaning position relative to the pool surface as the free end of the hose whips from side to side.

The reactant force of the remaining radially directed jets J2 from the orifices 20 against the body of water also tend to slow down the whipping action so that the one jet which is discharged onto the pool surface is maintained in a pool cleaning position for a greater length of time than is possible with a conventional single orifice whip hose nozzle. Because conventional single orifice whip hose nozzles have no counteracting jets, the free end of the hose whips rapidly from side to side and is quickly repelled away from the pool surface by the single forwardly directed jet.

Figure 4:
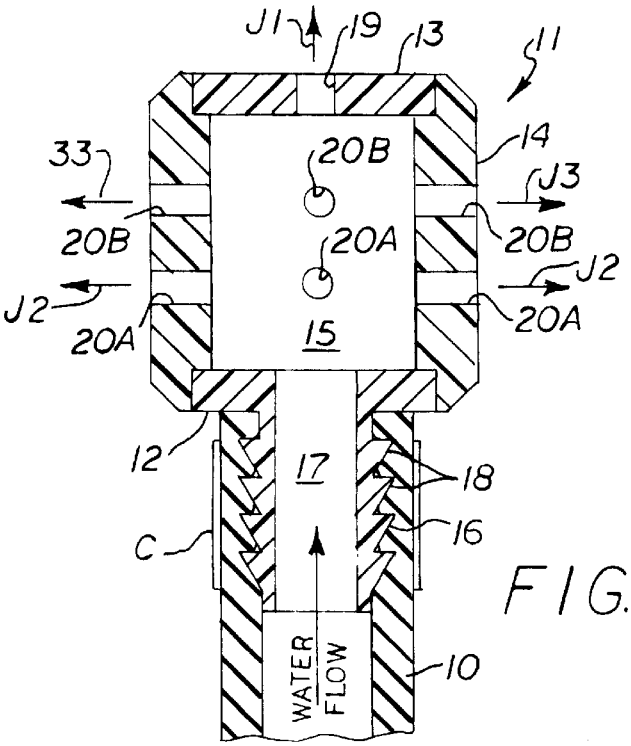
FIG. 4 is a longitudinal cross section through a second embodiment of the multi-orifice algae cleaning tip.

As shown in FIG. 4, the multi-orifice algae cleaning tip 11 may also be provided with a first plurality of circumferentially spaced orifices 20A and a second plurality of circumferentially spaced orifices 20B spaced longitudinally from the first plurality. This modification produces a slower whipping action than the embodiment previously described and directs two pressurized jets J2 and J3 of water onto the pool surface.

Figure 6:
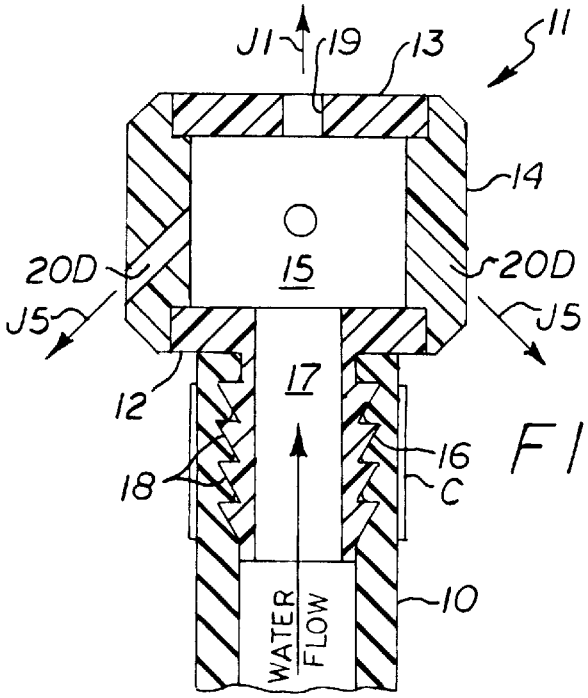
FIG. 6 is a longitudinal cross section through a fourth embodiment of the multi-orifice algae cleaning tip.
Figure 5:
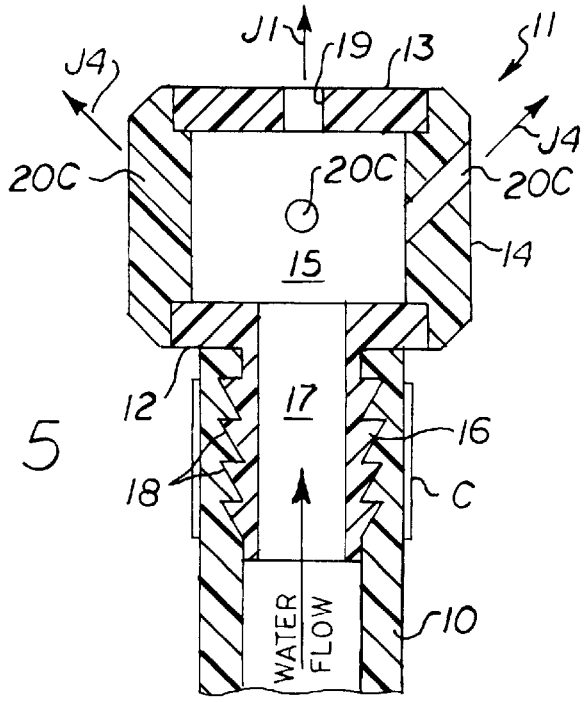
FIG. 5 is a longitudinal cross section through a third embodiment of the multi-orifice algae cleaning tip.

As shown in FIG. 5, the multi-orifice algae cleaning tip 11 may also be provided with a plurality of circumferentially spaced orifices 20C which extend through its side wall 14 at an angle with respect to the longitudinal axis of the cleaning tip. The angled orifices 20C discharge a plurality of jet streams J4 of water radially outward and forwardly in the direction of the water flow. As shown in FIG. 6, the multi-orifice algae cleaning tip 11 may also be provided with a plurality of circumferentially spaced orifices 20D which are angled to discharge a plurality of jet streams J5 of water radially outward and rearwardly in the reverse direction of the water flow.

In the modifications (FIGS. 5 and 6) having angled orifices 20C and 20D, at least one of the radially outward and angularly directed jet streams will be directed generally angularly onto the surface of the pool while the remaining radially and angularly directed jets will counteract the repelling force of the one jet and hold it in a cleaning position relative to the pool surface as the free end of the hose whips from side to side. This modification produces a faster whipping action if the circumferential jets are discharged downstream in the direction of water flow and a slower whipping action if discharged upstream in a direction reverse of the water flow.

It should be understood that the speed of the whipping action depends upon the angle of the orifices relative to the direction of water flow. If the circumferentially spaced orifices direct a plurality of jets radially outward perpendicular to the water flow (FIGS. 3 and 4), the perpendicular radial jets tend to hold the tip 11 stationary and whipping action is controlled by the single downstream directed jet J1 discharged through the top wall 13 of the cleaning tip.

If the circumferentially spaced orifices direct a plurality of jets radially outward and angularly forward in the direction of the water flow (FIG. 5), the reactant force is divided into a lateral force component and an upstream force component whereby the counteracting force will be reduced and the sinuous whipping action will be increased due to the angularly forward directed jets tending to propel the tip rearward.

If the circumferentially spaced orifices direct a plurality of jets radially outward and angularly rearward in the reverse direction of the water flow (FIG. 6), the reactant force is divided into a radial lateral force component and a downstream force component whereby the counteracting force will be reduced and the sinuous whipping action will be reduced since the angularly rearward directed jets will tend to drive the tip forward and apply tension in the hose. The radial force component and the upstream or downstream force components that control the sinuous whipping action may be varied depending on the angle of the jets relative to the water flow.

Referring again to FIG. 1, the whip hose 10 may also be provided with a plurality of disk-shaped wear rings 21 having a diameter greater than the hose diameter spaced axially along the length of the whip hose to prevent abrading hose contact with the pool surface, and one or more tubular brush attachments 22 formed of foam rubber or plastic or other suitable material installed along the length of the whip hose between the wear rings 21 and/or near the free end of the hose. The brush has a diameter sufficient to engage and brush the pool surfaces to dislodge algae and particulate matter adhered thereto as the hose whips from side to side.

While this invention has been described fully and completely with special emphasis upon several preferred embodiments, it should be understood that within the scope of the appended claims the invention may be practiced otherwise than as specifically described herein.

I claim:

1. A multi-orifice algae cleaning tip for attachment to the free end of a flexible pool whip hose, consisting of:

a hollow cylindrical cleaning tip having a bottom wall, a flat top wall, and a cylindrical side wall defining an unobstructed central chamber having a longitudinal axis, said central chamber having a substantially constant internal diameter from the bottom wall to the top wall;

a tubular extension extending from said bottom wall having a smooth unobstructed central bore in fluid communication with said central chamber and an exterior sized and shaped to be engaged in the free end of a flexible pool whip hose, said extension bore having a substantially constant internal diameter;

a single central orifice extending through said top wall in fluid communication with said central chamber for discharging a pressurized jet stream of water axially therefrom in the direction of water flowing through said hose to create a reactant force causing said hose to move along the bottom surface of a pool of water in a sinuous whipping action; and a plurality of circumferentially spaced orifices extending through said side wall at an angle relative to said longitudinal axis in fluid communication with said central chamber for discharging a plurality of pressurized jet streams of water angularly forward and radially outward therefrom in a downstream direction with respect to the direction of water flow, such that at least one of said angularly forward and radially outward discharged jet streams is directed angularly onto said pool surface in a pool cleaning position to dislodge algae and debris adhered thereto and the remaining radially discharged jets create a reactant force having an radial force component urging said at least one jet into the pool cleaning position and an rearward upstream force component in the reverse direction of water flow causing said hose to move along the bottom surface of a pool of water in a sinuous whipping action.

* * * * *